United States Patent [19]

King et al.

[11] 4,131,979

[45] Jan. 2, 1979

[54] MACHINE FOR CONTINUOUS BIAS CUTTING OF TUBULAR FABRIC

[75] Inventors: J. Frank King; Donald A. Sloan, both of Winston-Salem, N.C.

[73] Assignee: Hanes Corporation, Winston-Salem, N.C.

[21] Appl. No.: 786,473

[22] Filed: Apr. 11, 1977

Related U.S. Application Data

[63] Continuation-in-part of Ser. No. 644,569, Dec. 29, 1975.

[51] Int. Cl.[2] ..... B21D 43/00; B26D 3/16

[52] U.S. Cl. ..... 29/2.19; 83/180

[58] Field of Search ..... 29/2.1–2.25; 83/178, 180, 187, 425.3, 505, 506; 242/57, 65

[56] References Cited

U.S. PATENT DOCUMENTS

| | | | |
|---|---|---|---|
| 1,356,485 | 10/1920 | Bunker | 29/2.13 |
| 1,659,453 | 2/1928 | Berry | 29/2.15 |
| 1,753,645 | 4/1930 | Camfield | 29/2.19 |
| 1,876,600 | 9/1932 | Bommer | 29/2.16 |
| 1,896,596 | 2/1933 | Seddon | 29/2.15 |
| 1,955,282 | 4/1934 | Gardner et al. | 29/2.23 |
| 2,110,856 | 3/1938 | Gardner et al. | 29/2.21 |
| 2,644,522 | 7/1953 | Parker | 29/2.21 |
| 2,796,933 | 6/1957 | De Gelleke | 83/506 |
| 2,895,596 | 7/1959 | Kuypers | 29/2.15 |
| 2,985,944 | 5/1961 | Judelson | 29/2.2 |
| 3,026,599 | 3/1962 | Leff | 29/2.16 |
| 3,114,193 | 12/1963 | Lynam | 29/2.17 |
| 3,734,307 | 5/1973 | De Gelleke et al. | 242/65 |
| 3,971,520 | 7/1976 | Shimai | 242/35.5 A |

*Primary Examiner*—Othell M. Culver Simpson
*Attorney, Agent, or Firm*—Frailey & Ratner

[57] ABSTRACT

Automated machine for the continuous bias cutting of an elongated tube of material, such as tubular knitted fabric, into a plurality of individual strips, and winding the strips into a plurality of rolls. The tubular material is advanced axially at a uniform rate from a supply to a cutting and rolling section by a plurality of skewable rotatable cylinders acting as a positive feeding means. As the tubular material is withdrawn from the supply, it passes over a spreader which opens and tensions it. The skewed cylinders cause the tube to rotate about its axis as it advances. Control means are utilized to adjust automatically the skew angles of the cylinders, to increase or decrease the rate of advance of the tube, to compensate for variations inherent in the material which affect its rate of feed. Control means also are utilized to adjust automatically the tension exerted by the spreader, to correlate such tension with the rate of advance as determined by the skew angles of the cylinders. A doffing mechanism is provided, to permit automatic removal of the cut rolls of material after reaching a selected size. The machine maintains the tube substantially untwisted, relative to its axis, and under substantially uniform tension, while advancing it wrinkle-free to the cutting and rolling section of the machine at a uniformly maintained rate of feed.

28 Claims, 22 Drawing Figures

XVI
XVI

MACHINE FOR CONTINUOUS BIAS CUTTING OF TUBULAR FABRIC

RELATED APPLICATION

This application is a continuation-in-part of U.S. Pat. application Ser. No. 644,569 filed Dec. 29, 1975, entitled "Machine for Continuous Bias Cutting of Tubular Fabric".

BACKGROUND OF THE INVENTION

This invention relates to machines for the continuous bias cutting of elongated tubes of material, such as tubular knitted fabric, into a plurality of individual strips, and winding the strips into rolls. Machines for accomplishing this purpose are old, and have assumed various forms and designs over the decades. Usually, such machines employ mandrels over which tubular material is pulled or dragged to a cutting means, where the tubular material is cut into one or more strips. In some instances, multiple cutters have been used for cutting tubular material simultaneously into multiple strips, and means provided for winding the strips into separate rolls. Examples of such machines are illustrated in the following U.S. Pat. Nos. 1,356,485, 1,659,453, 1,753,645, 1,896,596, 1,955,282, 2,110,856, 2,644,522, 2,796,933, 2,895,596, 2,985,944, 3,026,599, 3,114,193 and 3,734,307.

SUMMARY OF THE INVENTION

This invention comprises an improved machine for the continuous bias cutting of an elongated tube of material, such as tubular knitted fabric, into a plurality of individual strips, and winding the strips into rolls. The improved machine of this invention eliminates wastage for most of the tubular materials to be cut, while providing means for cutting it into plural strips of uniform width. A spiral type cutter is used, having a plurality of rotatable crush-cutting blades each of which continuously cuts the tubular material in the form of a helix, thereby producing a plurality of continuous lengths of helical cut strips of material. A primary use of the machine is to cut tubular knitted fabric into binding material for garments.

The primary object of this invention is to provide a new and improved automated machine for the continuous bias cutting of tubular material into a plurality of continuous strips of uniform width, having cut edges of uniform smoothness, without wastage of the material.

A further object of the invention is to provide a novel tube advancing means for advancing positively, at a uniformly maintained rate of feed, the tubular material from a source of supply to a plurality of cutters, for cutting the material into plural strips, while maintaining the tubular material substantially untwisted relative to its axis during its advancement.

A further object is to provide selectively controllable tube advancing means for advancing axially the tubular material, wrinkle-free and under uniform tension, as it passes from the source of supply to the cutters.

A further object is to provide a new and improved automated machine for the continuous bias cutting of tubular material into a plurality of continuous strips and the winding of the strips into rolls, which incorporates a doffing mechanism automatically operative to remove the several rolls of cut material from the machine after the rolls reach a selected size.

A further object is to provide sensing and control means for monitoring the advance of the tubular material to the cutting and rolling section of the machine and for automatically controlling the rate of advance of the material, continuously during machine operation, to maintain substantially uniform the feeding of an extremely delicate material to provide accurate and uniform spiral cutting with a minimum of waste.

A further object is to provide a method for the continuous, uniform and waste-free bias cutting of an elongated tube of material into a plurality of helically cut strips, and the winding of the cut strips into a plurality of separate rolls, in which tubular material is advanced by a positive feeding means from a supply to a plurality of cutters at a uniform feeding rate, including the steps of applying a selected tension to the material to enable it to advance wrinkle-free to the cutters, continuously monitoring the advancing tube and adjusting automatically its rate of advance and the tension applied thereto, as required during machine operation, to advance the tube continuously in wrinkle-free condition at the uniform rate of feed, and doffing automatically the plural rolls of cut material after they have reached a predetermined size.

To achieve the foregoing objectives, the tubular material is stored in untensioned condition in the form of a stack of flattened, superimposed folds in a rotatable receptacle, and is advanced axially from the receptacle to cutting and rolling means by a plurality of rotatable, skewed cylinders, which rotate the tube as it advances, and function as a positive feeding means for the material. As the tube is withdrawn from the receptacle by the cylinders, it passes over a spreader which opens and selectively tensions the advancing tube. Speed control means are provided to correlate the speed of rotation of the supply receptacle with the speed of rotation of the tube about its axis, as it is advanced by the skewed cylinders, to maintain the tube substantially untwisted. Control means adjust automatically, as required during machine operation, the skew angles of the cylinders and the tension exerted by the spreader, to adjust the speed of advancement of the tubular material to maintain a uniform, wrinkle-free feeding rate. An automated doffing mechanism is operative to remove automatically from the machine the several rolls of cut material after they have reached predetermined size, and, following doffing, to commence automatically a new machine cycle.

Other objects and advantages of this invention will be readily apparent from the following description of a preferred embodiment thereof, reference being had to the accompanying drawing.

DETAILED DESCRIPTION OF THE BASIC MACHINE OF THE INVENTION

Figure 1:
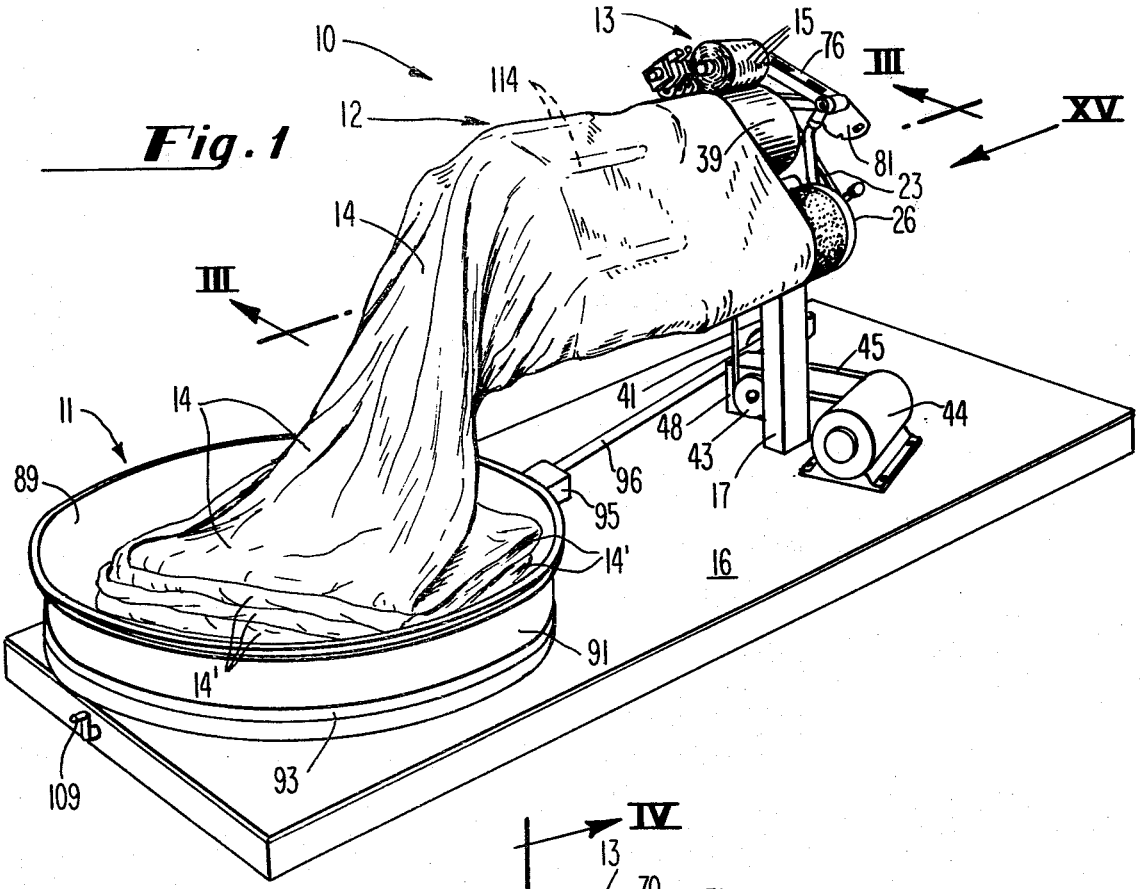
FIG. 1 is a view in perspective showing a preferred fabric cutting machine of this invention in the process of cutting tubular fabric into plural strips and winding the cut strips into rolls.
Figure 2:
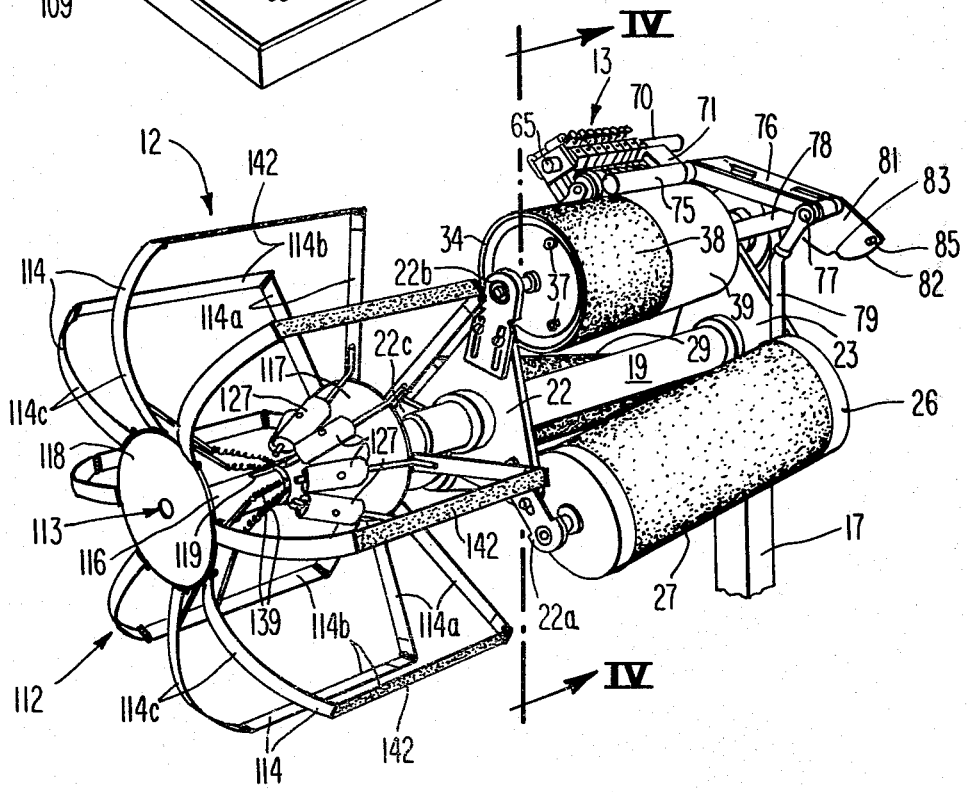
FIG. 2 is an enlarged, fragmentary view in perspective showing the upper portion of the machine of FIG. 1, with the fabric removed.
Figure 3:
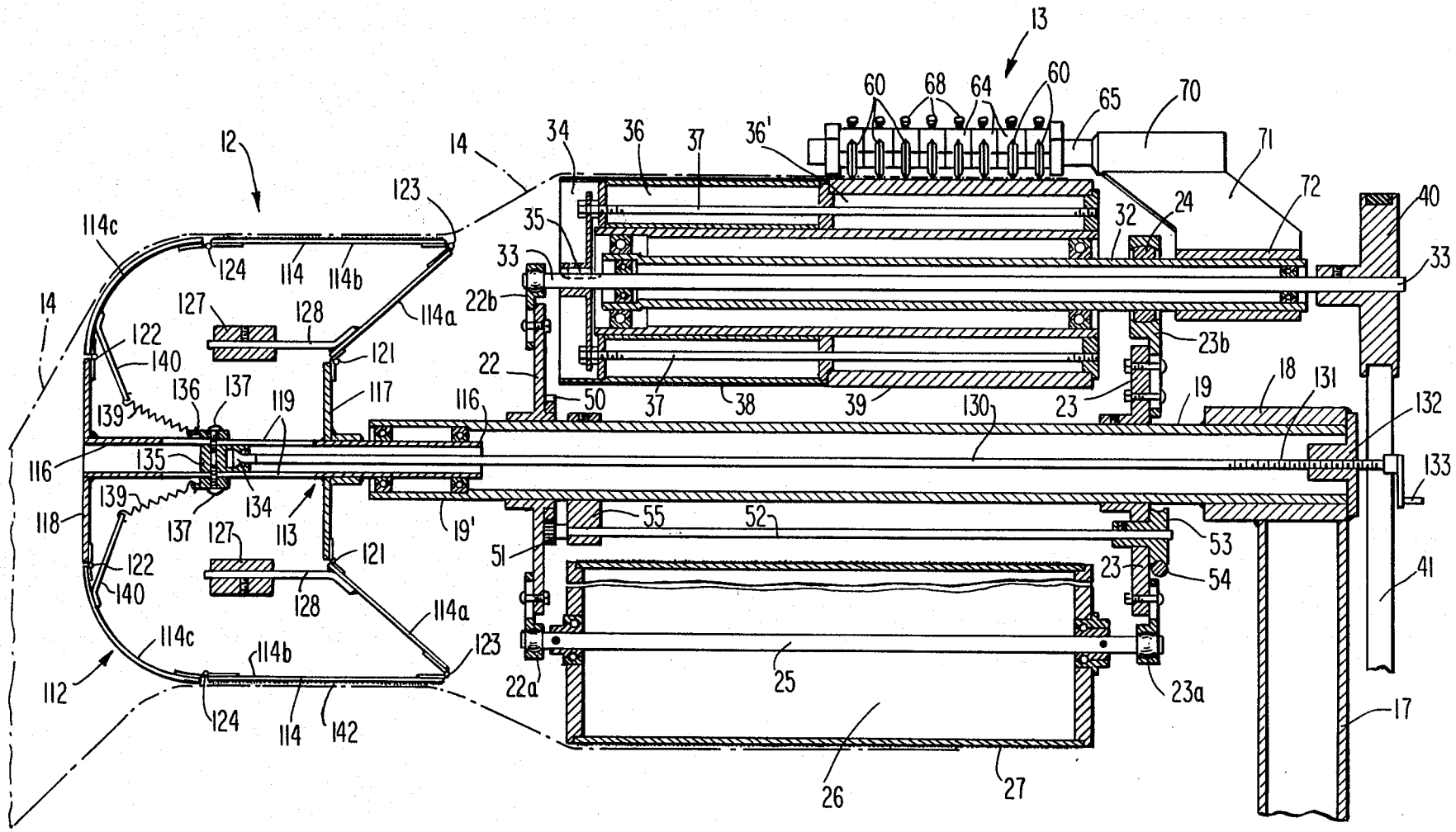
FIG. 3 is an enlarged, fragmentary view in section indicated by the arrows III—III of FIG. 1.

FIGS. 1–3 illustrate the preferred fabric cutting machine 10 of U.S. Pat. application Ser. No. 644,569 aforesaid, the disclosure of which is incorporated herein by reference. FIGS. 4–16 inclusive illustrate a modification of the machine 10, the modified machine being denoted 10′.

Referring initially to FIGS. 1–3, the machine 10 biascuts a continuous tube 14 of a seamless knitted fabric into a plurality of individual, helically cut, continuous strips, and forms the cut strips into a plurality of separate rolls 15. The machine is composed of a fabric supply section 11, a fabric spreading and tensioning section 12 and a fabric cutting and rolling section 13. It is supported by a base structure which includes a vertical standard 17 affixed rigidly to a horizontal base 16. Affixed to the top of standard 17 is a horizontal axis collar 18 (FIG. 3). Secured rigidly within collar 18 is one end of an elongated, horizontal, tubular support shaft 19. The base 16, standard 17, collar 18 and shaft 19 comprise the supporting structure of the machine 10.

Figures 7, 15, 16:
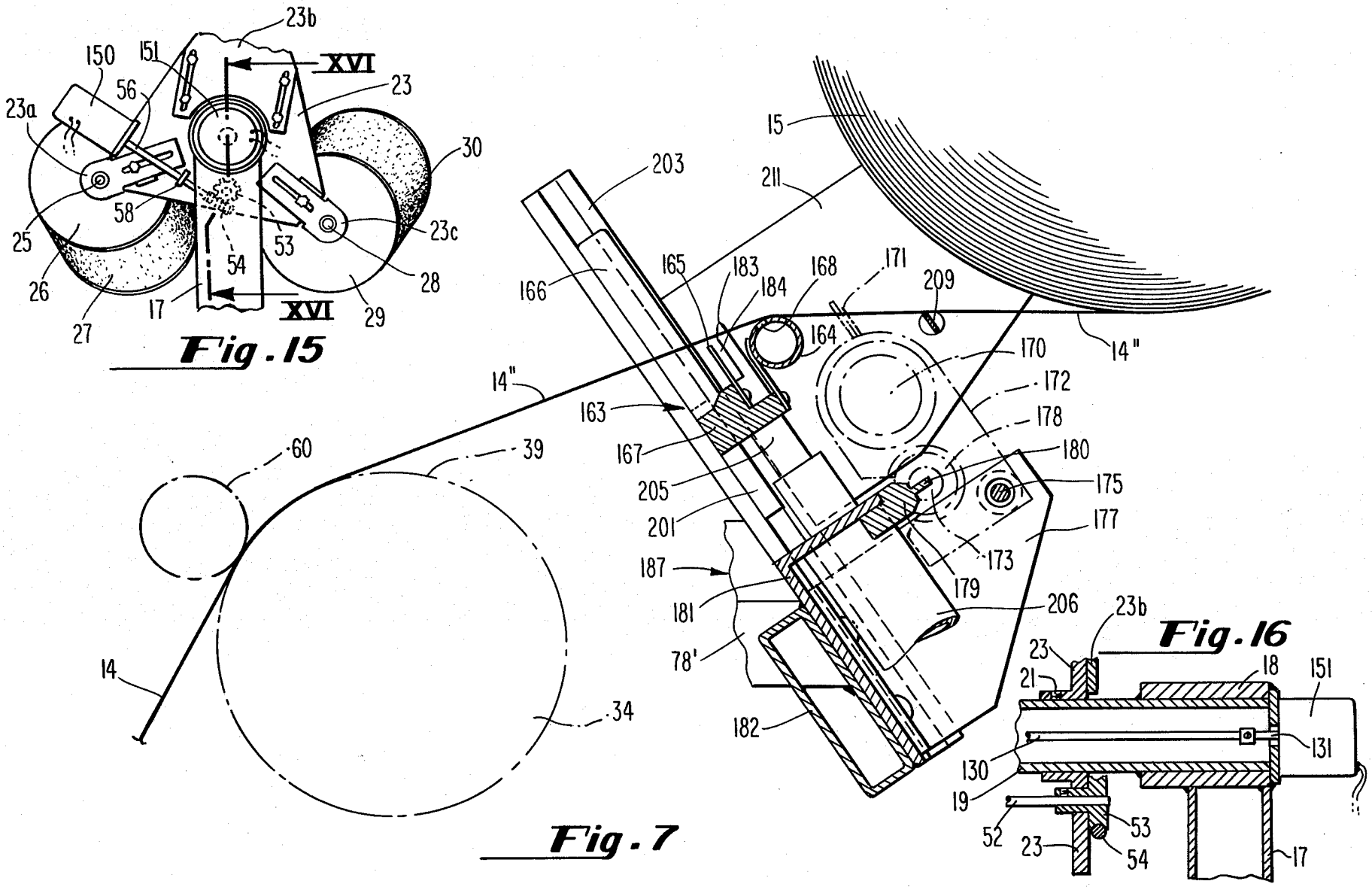
FIG. 7 is an enlarged, fragmentary view in section indicated by the arrows VII—VII of FIG. 5.
FIG. 15 is a fragmentary view in elevation looking in the direction of the arrow XV of FIG. 1, but showing the modified machine.
FIG. 16 is an enlarged, fragmentary view in section indicated by the arrows XVI—XVI of FIG. 15.

Mounted externally on the hollow shaft 19 are a pair of horizontally spaced, vertical end plates 22, 23 of generally equilateral triangular configuration. Secured to the three radially disposed apices of end plate 22 are adjusted brackets 22*a*, 22*b*, 22*c*, each of which mounts at its distal end conventional ball joint. In similar fashion, there is mounted at the radially disposed apices of end plate 23 adjustable brackets 23*a*, 23*b*, 23*c* (FIG. 2, 3, 15), each of which also supports a conventional ball joint. Each of the three ball joints of end plate 22 are disposed in opposing relation to one of the three ball joints of end plate 23. The end plate 22 is movable angularly relative to the axis of shaft 19, but end plate 23 is secured rigidly to shaft 19 by any suitable means, such as a set screw 21 (FIG. 16).

The spaced ball joints of brackets 22*a*, 23*a* support a stationary shaft 25 on which is mounted a rotatable cylinder 26, the outer periphery of which is provided with a roughened friction surface 27 (FIG. 3). Similarly, the spaced ball joints of brackets 22*c*, 23*c* support a stationary shaft 28 on which is mounted a rotatable cylinder 29, the outer periphery of which also is covered with a friction material 30 (FIGS. 2, 15).

The ball joint 24 (FIG. 3) of bracket 23*b* supports a non-rotatable tubular shaft 32. Mounted within the hollow of shaft 32 is a rotatable shaft 33 having its left-hand end, as viewed in FIG. 3, mounted in the ball joint supported by bracket 22*b*. Affixed to the right-hand end of shaft 33 is a timing pulley 40, about which is entrained a timing belt 41, by which rotation is imparted to shaft 33. A rotatable cylinder 34 is keyed to the shaft 33 at 35. The cylinder 34 is composed of two axially aligned cylinder segments 36, 36′ secured by three elongated bolts 37. The periphery of cylinder segment 36 is covered by a friction material 38, whereas the periphery 39 of cylinder segment 36′ is formed of hardened steel. A drive system including motor 44, belt 45, gear reducer 48, pulley 43, belt 41 and pulley 40 imparts rotation to cylinder 34 (FIGS. 1, 3).

The cylinders 26, 29, 34 are mounted in a generally equilateral triangular pattern around the axis of the center shaft 19. The cylinders 26, 29, 34 are adjustable radially relative to the fixed support 19 by the inward or outward radial adjustment of brackets 22*a*, 22*b*, 22*c*, 23*a*, 23*b*, 23*c*, to open, spread and tension the fabric tube 14, to ensure accurate and reliable cutting of the tube into continuous fabric strips. In preparing the machine 10 for fabric cutting operation, the cylinders 26, 29, 34 are skewed relative to each other and also relative to the longitudinal axis of the machine. Skewing the cylinders permits them to act as a positive feeding means for the tubular fabric 14, to advance the fabric tube at a uniform rate to the fabric cutting section 13 of the machine. The advancing fabric is caused to move circumferentially about its tubular axis by the driven cylinder 34. Since the idler cylinders 26, 29 are freely rotatable, rotational drive is imparted to them by the rotating tube of fabric 14.

The cylinders 26, 29, 34 are rendered skewable relative to each other and to the machine axis by the ball joints which support their respective shafts 25, 28, 33. Skewing of the cylinders is accomplished by angular movement of end plate 22 about the axis of support shaft 19. Adjustment means for selectively skewing of the cylinders includes an annular gear 50 (FIG. 3) affixed to the inner face of end plate 22 and a pinion 51 meshing with gear 50 and affixed to one end of a turnable elongated rod 52. Affixed to the opposite end of rod 52 is a rotatable helical gear 53 which meshes with a worm 54. Rod 52 is supported rotatably adjacent end plate 22 by a bracket 55. At the opposite end of rod 52, helical gear 53 is supported rotatably by end plate 23.

As illustrated by FIG. 15, in both machines 10 and 10′, the worm 54 is disposed at the inner end of a stem 56, which is supported turnably on plate 23 by a bracket 58. Selective turning of the stem 56, in either angular direction, causes rod 52 and pinion 51 to turn gear 50 to adjust selectively the angular position of end plate 22 relative to support 19 and end plate 23. Selective adjustment of end plate 22 determines the skew angles at which the cylinders 26, 29, 34 are disposed relative to the axis of the machine.

The forward portion of the advancing tube of fabric 14 is bias cut into a plurality of continuous spiral strips of fabric by a plurality of axially spaced, spring loaded rotatable crush cutting rollers 60 (FIG. 3). Each cutting roller 60 is mounted rotatably at the bifurcated inner end of a bell crank 61 (FIG. 4) pivotally supported at 62 adjacent the lower end of a depending arm 63 of a bracket 64. A pin 66 is slidably supported by bracket 64, with capacity for axial movement. The upper end of pin 66 is provided with a threaded nut 68, and a coil spring 67 surrounds the pin between the bracket 64 and the nut 68. Each of the brackets 64 is affixed by suitable means, such as a key, to a stud shaft 65 disposed parallel to shaft 33 of cylinder 34. The stud shaft 65 is mounted in the distal end 70 of a bracket 71 affixed to a collar 72. Collar 72 is mounted externally of the stationary hollow support shaft 32, between end plate 23 and timing pulley 40. The spring biased circular cutting edges of the rollers 60 engage the hardened steel periphery 39 of cylinder 34. The frictional contact between the periphery of driven cylinder 34 and the cutting rollers 60 causes the latter to rotate as the cylinder rotates.

The cut strips of fabric are rolled up on, and formed into plural rolls 15 by, a mandrel 75 (FIG. 2) rotatably supported in the distal end of a swingable arm 76 pivotable about a stud shaft 77. The stud shaft 77 is supported by a pair of brackets 78, 79. Bracket 78 is affixed to the collar 72 and extends outwardly therefrom. Bracket 79 has its lower end (not shown) secured at some suitable location to the machine 10.

Preparatory to the operation of the machine, the bare mandrel 75 rests against the hardened steel surface 39 of the cylinder 34. The mandrel is disposed parallel to the rotatable shaft 33 of the driven cylinder 34, and is spaced arcuately a small distance from the crush cutting rollers 60. The frictional surface contact between the periphery 39 of the rotating cylinder 34 and the mandrel 75 causes the mandrel to rotate. The cut fabric strips passing from the gang of cutters 60 continuously roll up on the mandrel to form the plural individual fabric rolls 15.

As the fabric rolls 15 progressively increase in size, the mandrel 75 and its arm 76 gradually swing outward, away from cylinder 34, about pivot 77. In the machine 10 shown in FIGS. 1-3, when the rolls 15 have reached a predetermined size, a notch 83 in the cam edge 82 of the quadrant 81 engages the outer end of a microswitch actuator, activating a switch to stop the machine. The several rolls 15 of cut fabric are removed from the mandrel 75, and the bare mandrel is swung back into contact with the surface 39 of the cylinder 34, preparatory to the next operative cycle of the machine. A pin 85 contacts bracket 78, when mandrel arm 76 is swung outwardly from the cylinder 34 a selected distance, and acts as a stop to limit the arcuate displacement of mandrel 75 away from the machine.

The fabric supply section 11 includes a bowl-shaped receptacle 89 for receiving the fabric tube in the form of a package of multiple superimposed, rectangular folds 14'. The fabric tray 89 is retained securely in a vertically mounted rotatable support cylinder 91. Rotation is imparted to the support cylinder 91, and hence to fabric tray 89, by a drive belt 93 driven from a variable speed pulley of the variable diameter spring-loaded type (not shown). The pulley is connected to a drive shaft 96 by a gear reducer 95. Motor 44 drives shaft 96 by means of a drive system which includes belt 45 and suitable interposed timing pulleys and belts.

Interposed between the fabric supply tray 89 and the cylinders 26, 29, 34, at the fabric spreading and tensioning section 12, is a freely rotatable fabric spreader 112. As the fabric tube 14 advances from the supply tray to the cylinders, it passes over the spreader 112, which opens the fabric and imparts a frictional drag thereto. The fabric spreader 112 is composed of a central core 113 which supports a plurality of articulated, annularly spaced ribs 114 each composed of links 114*a*, 114*b*, 114*c*.

The spreader core 113 includes a rotatable tubular support 116 mounted for rotation on roller bearings disposed within the distal end 19' of the horizontal tubular support shaft 19. Affixed to tube 116 are a pair of axially spaced circular plates 117, 118. Formed in the wall of tube 116 are a plurality of circumferentially spaced, axially extending slots 119. The slots 119 correspond in number to the articulated ribs 114, and each slot 119 is disposed in a radial plane with one of the ribs 114.

The several rib segements 114*a* and 114*c* are connected to circular plates 117, 118 by hinge-like joints 121, 122 (FIG. 3). The opposite ends of the rib segments 114*a*, 114*c* are connected to their intermediate segments 114*b* by hinge-like joints 123, 124. The articulated construction of the plural ribs 114 renders the spreader 112 self-adjusting diametrically, to compensate for variations in diameter of the tubular fabric 14 passing from the fabric supply tray 89 to the rotatable cylinders 26, 29, 34. The fabric spreader 112 is caused to rotate about its horizontal axis by the revolving tube of fabric 14. To counteract the centrifugal force on the rib segments 114*b*, a plurality of weights 127 are provided. Each weight 127 is affixed to the distal end of a rod 128, the proximal end of which is affixed to one of the rib segments 114*a*.

The spreader 112 continuously exerts a selected outwardly directed tension on the fabric, to create a longitudinal or axial drag or retarding effect on the advancing tube 14. The selected tension eliminates wrinkles on the advancing fabric tube, while assisting in regulating its rate of advance to the cutters 60. There is provided, internally of, and co-axial with, the hollow support tubes 19, 116, an elongated rod 130 having its threaded end 131 supported within the correspondingly threaded aperture of a cap 132 affixed to the end of tube 19 adjacent collar 18. In the machine 10, the end 131 of rod 130 extends outwardly beyond cap 132, where it is provided with a handle 133 (FIG. 3). By reason of the threaded engagement between the threads of rod end 131 and the internal threads of the cap 132, rod 130 may be advanced or retracted axially, relative to tubes 19, 116.

Formed at the opposite end of rod 130 is a knob 134 to which is secured a cylindrical core 135 disposed slidably within support tube 116. Disposed externally of tube 116, in the same vertical plane as the core 135, is a ring 136. Ring 136 is affixed to the core 135 by a plurality of bolts 137 which extend through the slots 119 formed in support tube 116.

Mounted on each of the rib segments 114*c* is an inwardly inclined rod 140. Affixed to the distal end of each rod 140 is one end of a coil spring 139, the opposite end of which is affixed to the ring 136. The springs 139 urge the articulated ribs 114 radially outward, thus tending to expand diametrically the spreader 112 and the advancing fabric tube 14. Axial movement of the core 135 and ring 136 relative to the support tube 116 will increase or decrease tension on the circle of springs 139, to vary selectively the degree of fabric tension exerted by the annularly spaced ribs 114. The core 135 and ring 136 may be selectively positioned axially, relative to tube 116, by turning the adjustment rod 130. Thus, rod 130, core 135, ring 136, springs 139 and rods 140 provide means to vary selectively the internal tension imposed by the spreader 112 on the advancing tube of fabric 14. If desired, the outer surfaces of the rib segments 114*c* may be provided with a suitable friction material 142.

Detailed Description of the Modified Machine of the Invention

FIGS. 4 to 16 illustrate a modified, more completely automated machine 10' incorporating this invention. In FIGS. 4 to 16, the reference numerals identical to those utilized in FIGS. 1 to 3 designate parts or elements which are common to both machines. In the machine 10' there is incorporated control means for maintaining uniform the rate of advance of the tubular fabric 14 to the fabric cutting and rolling section 13. As illustrated in FIGS. 15 and 16, this is achieved by the utilization of suitable reversible drive devices 150, 151, such as reversible rotary actuators or AC reversible gear motors.

More specically, there is mounted to the outer end of stem 56 a reversible drive device 150 for the selective turning of the stem, and its associated parts, comprising worm 54, gear 53, rod 52, pinion 51 and gear 50 affixed to end plate 22 (FIG. 3). The actuation of device 150, either forward or reverse, results in the automatic adjustment of the skew angles of the skewable cylinders 27, 29, 34.

Mounted adjacent the end 131 of rod 130, in place of the handle 133 of machine 10 (FIG. 3), is the reversible drive device 151 (FIG. 16). The actuation of device 151, either forward or reverse, turns rod 130 to adjust automatically the amount of tension or drag exerted on the advancing tube of fabric 14 by the annularly spaced ribs 114 of the freely rotatable spreader 112.

The reversible drive devices 150, 151 are controlled by a photoelectric sensing mechanism or photoelectric cell 152 (FIG. 4), to which they are connected by suitable electric circuitry (not shown). The photoelectric cell 152 is mounted adjacent to, and just upstream of, the cutting and rolling section 13 of the machine 10'. It senses or monitors the advancing edge of the fabric tube 14, to ensure that the tube is advanced wrinkle-free at the proper feeding rate for waste-free cutting into helically cut strips. Should the advancing tube 14 incorporate inherent tension variations, or other variations in fabric characteristics, which tend to alter its rate of advance, cell 152 detects such change, and sends the appropriate corrective or adjustment signals to the rotary devices 150, 151. In response to such signals, the devices 150, 151 adjust automatically, as necessary, the skew angles of the cylinders 26, 29, 34 and the fabric tension exerted by the spreader 112.

Such adjustments of skew angles and fabric tensions are correlated, to compensate fully for any tendency for change in the rate of feed of the tube 14 caused by variable characteristics in the fabric. If the photoelectric cell 152 senses that the rate of fabric feed should be increased, to maintain wrinkle-free and waste-free cutting, device 150 turns rod 52 to increase slightly the skew angles of the cylinders, thereby increasing the rate at which they positively feed the tubular fabric to the cutters 60. At the same time, device 151 turns rod 130 slightly, to decrease correspondingly the drag exerted on the advancing tube of fabric 14 by the spreader 112. If cell 152 senses that the rate of fabric feed should be decreased, it transmits corrective signals to devices 150, 151, whereby they are actuated automatically to decrease the skew angles of the cylinders 26, 29, 34 while increasing the amount of fabric tension or drag exerted by the spreader 112.

By reason of the employment of the fabric sensing means 152 and the reversible drive devices 150, 151, it is possible to maintain the advancing edge of the tubular fabric at a substantially constant location relative to the gang of cutters 60, thereby providing waste-free cutting of the fabric into helically cut strips. The arrangement ensures the maintenance of precision controlled fabric delivery, cutting and rolling, producing a plurality of cut strips of fabric of uniform width, with smooth cut edges.

Although the invention achieves waste-free spiral cutting for most materials, it has been found in practice that some highly flimsy, flexible or relatively elastic types of tubular materials, such as rotary knit fine gauge fabrics, do not have sufficient stability nor uniformity to permit continuous cutting into plural strips without occasional incidental waste. With such delicate fabrics, some wastage may be unavoidable, despite the automatically operative adjustment means 152, 150, 151, designed to ensure uniform feeding of the tubular fabric 14 to the cutters 60. To compensate for such wastage when it develops, an extra cutter 60' (FIG. 14) is provided. Cutter 60' trims from the advancing edge of fabric 14 any fabric wastage W which might develop as the result of irregular feeding of the fabric to the cutters. A suction tube 155 is provided to remove automatically any fabric wastage W trimmed by the cutter 60'. A small, skewed, freely rotatable friction wheel 156 trails cutter 60', to ensure that any trimmed fabric portion W is directed into the open mouth of suction tube 155. A spring 157 connected to pivot 62' of cutter 60' is provided to maintain the periphery of friction wheel 156 at all times in rotating contact with the periphery 39 of the rotatable cylinder 34.

As will be apparent, the photoelectric cell 152, reversible drive devices 150, 151 and the fabric edge trimmer 60', with its associated suction tube 155 and friction wheel 156, together comprise control means operative to ensure the bias-cutting of a plurality of uniform strips from an advancing tube of fabric, with nor or very little fabric wastage, irrespective of the delicate, flimsy or elastic quality of the material being cut.

Referring next to the schematic illustrations of FIGS. 13*a*–13*g*, the sequence of operation of the automatic mechanism for doffing the rolls 15 now will be described. FIGS. 13*a*–13*g* illustrate schematically rotatable cylinder 34, plural cutters 60, rotatable mandrel 75', swingable mandrel arm 76' and stud shaft 77' of the machine 10'. The mandrel 75' is provided with two diametrically spaced, longitudinally extending fabric stuffer or "threading" slots 74. Also illustrated is a flat, circular ejector pad or plate 160 having an enlarged notch 161 formed therein.

Figure 13A:
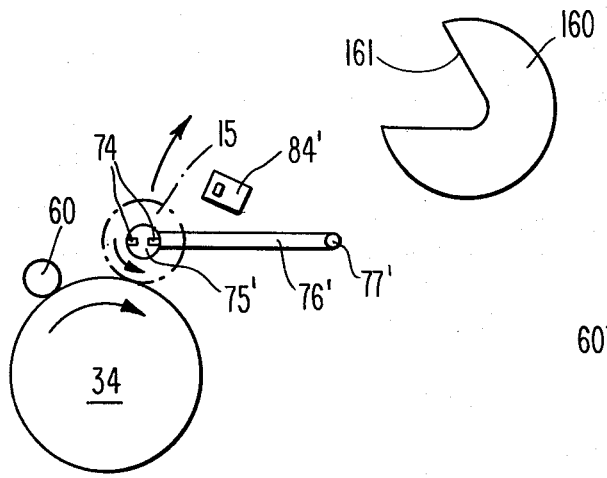
FIGS. 13*a* to 13*g* inclusive are schematic illustrations showing the sequence of operation of the automatic doffing mechanism of the modified machine.
Figure 13B:
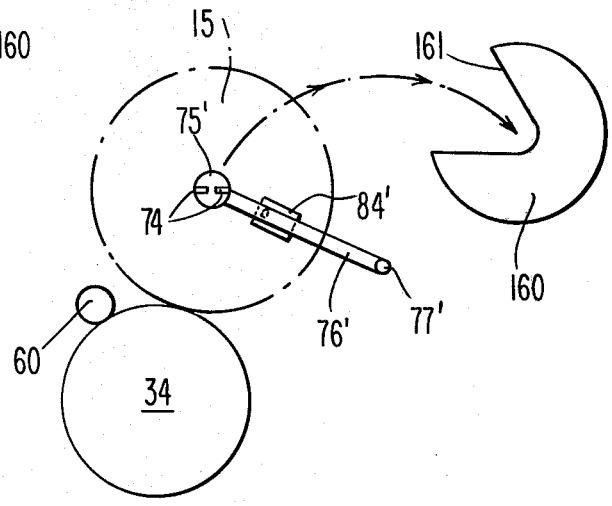
Figure 13C:
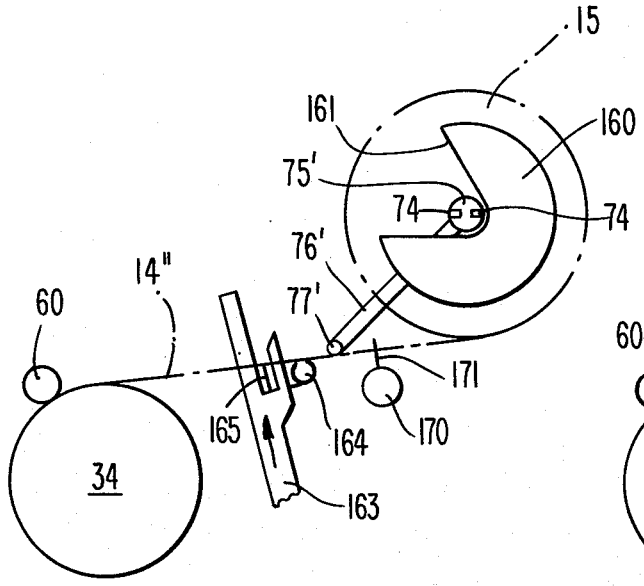

FIG. 13*a* depicts the rotatable mandrel 75' in the process of winding up the cut strips of fabric to form the plural fabric rolls 15. As the fabric rolls 15 progressively increase in size, the mandrel 75' and its arm 76' gradually swing outward, away from the cylinder 34. When the rolls 15 have reached a predetermined size (FIG. 13*b*), arm 76' engages the outer end of the actuator of microswitch 84' to activate that switch. The microswitch 84' starts an electric doff cycle programmer (not shown) of any suitable type, which causes the machine 10' to stop automatically. The doffing cycle, illustrated schematically in FIGS. 13*b* to 13*g* inclusive, proceeds under control of the programmer, the sequence of operation being as follows:

(1) Mandrel arm 76' is swung outwardly of the machine, about shaft 77', until an exposed portion of the mandrel 75' comes to rest in the bottom of the notch 161 of the ejector pad 160 (FIG. 13*c*). The plural rolls 15 now are in doffing position. As the mandrel 75' is retracted, trailing cut strips of fabric 14", still attached to the tubular fabric 14 on cylinder 34, are unwound from the rolls 15. A stuffer assembly 163 mounting an elongated, transversely extending pneumatic suction tube 164 and a transverse stuffer blade 165, is disposed below strips 14". The suction tube 164 is provided with a plurality of spaced, longitudinally disposed apertures along its upper surface. With the mandrel 75' fully retracted, the cut fabric strips 14" are draped tightly over the suction tube 164, which engages the cut fabric strips intermediate cylinder 34 and rolls 15.

(2) A motor driven rotary shear 170 (FIG. 13*c*) having a rotatable cutting blade 171 moves transversely across the unwound fabric strips 14" to sever them intermediate suction tube 164 and rolls 15, and then retracts. The cut ends of the strips 14" extending from the fabric tube 14 on cylinder 34 are retained by suction tube 164. After the strips 14" have been cut, ejector pad 160 is advanced to remove fabric rolls 15 from the mandrel 75, and then retracts.

(3) The stuffer assembly 163 now rises (FIG. 13*d*), with the cut ends of fabric 14" still retained by the suction of tube 164. The cut ends extend from tube 164 over the upper edge of stuffer blade 165 to cylinder 34. The mandrel arm 76' is advanced pivotally from ejector pad 160 in the direction of the cylinder 34, until the empty mandrel 75' contacts the upper end 166 of the stuffer assembly 163, stopping the advance of the arm 76'.

Figure 13D:
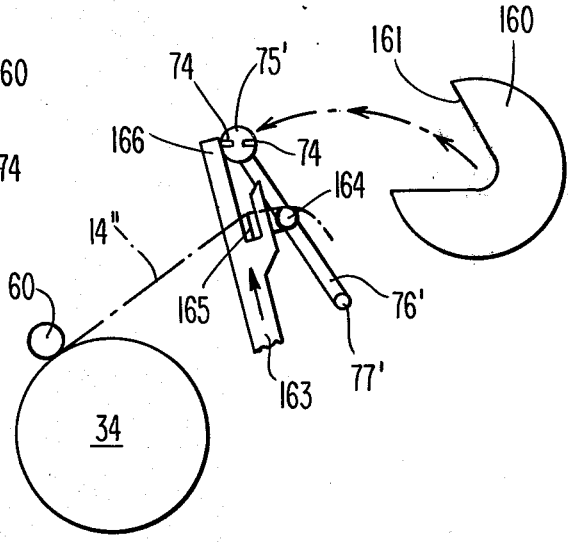
Figure 13E:
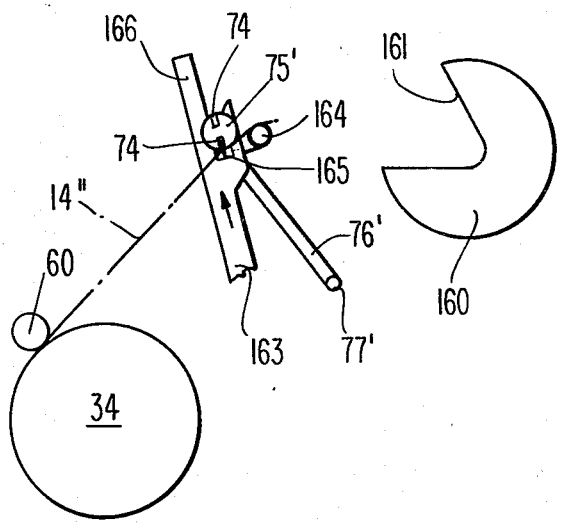
Figure 13F:
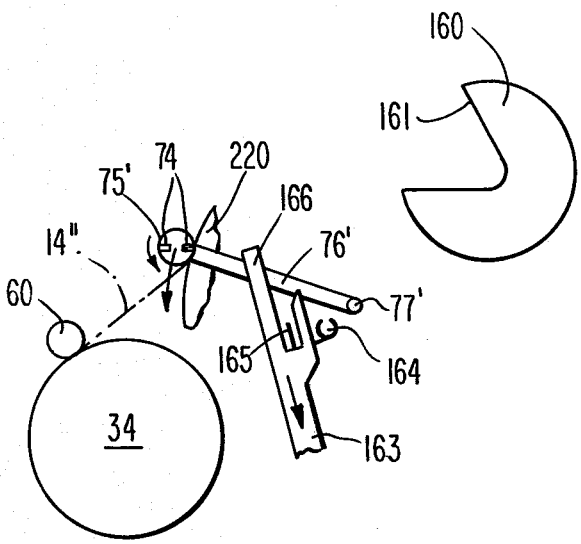
Figure 13G:
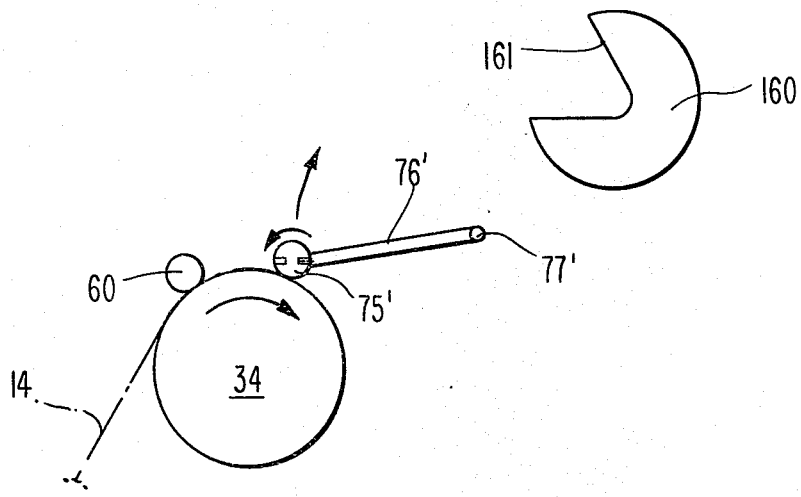

(4) Stuffer assembly 163 again rises (FIG. 13*e*). As it moves up, it causes the arrested mandrel 75' to be rotationally oriented so its spaced elongated slots 74 are disposed in co-planar relation to the transverse stuffer blade 165. As the stuffer assembly 163 completes its second upward advance, the stuffer blade 165 engages, folds and forces or "threads38 the cut ends of the fabric strips 14" into the lower slot 74.

(5) The stuffer assembly 163 then is retracted to its starting position (FIG. 13*f*), leaving the ends of the fabric strips 14" inserted in the lower slot 74 of the mandrel 75'. Upon the withdrawal of the stuffer assembly 163, the mandrel 75' and its arm 76' advance by gravity toward the periphery of the cylinder 34. As the mandrel 75' returns to cylinder 34, it is caused to rotate about its axis by a segmental plate 220, thereby wrapping the cut ends of the fabric strips 14" around the surface of the mandrel.

(6) When the mandrel 75' reaches fabric wind-up position relative to cylinder 34 (FIG. 13*g*), several turns of the cut ends of the fabric strips 14" have been wound about its peripheral surface. With the doff cycle now complete, the programmer starts the machine 10' to commence a fresh cycle of fabric feeding, cutting and rolling.

Thus, the automated machine 10' carries out a repeating succession of alternating cycles of operation. Each machine cycle of feeding, cutting and rolling the tubular fabric 14 into separate rolls 15 of predetermined size is followed by a doffing cycle. During the doffing cycle, the fabric rolls 15 are retracted from the cylinder 34, whereupon their trailing cut ends 14" are served automatically and the rolls 15 removed from the mandrel 75', following which the empty mandrel is re-threaded and returned to the cylinder 34.

Figures 4, 14:
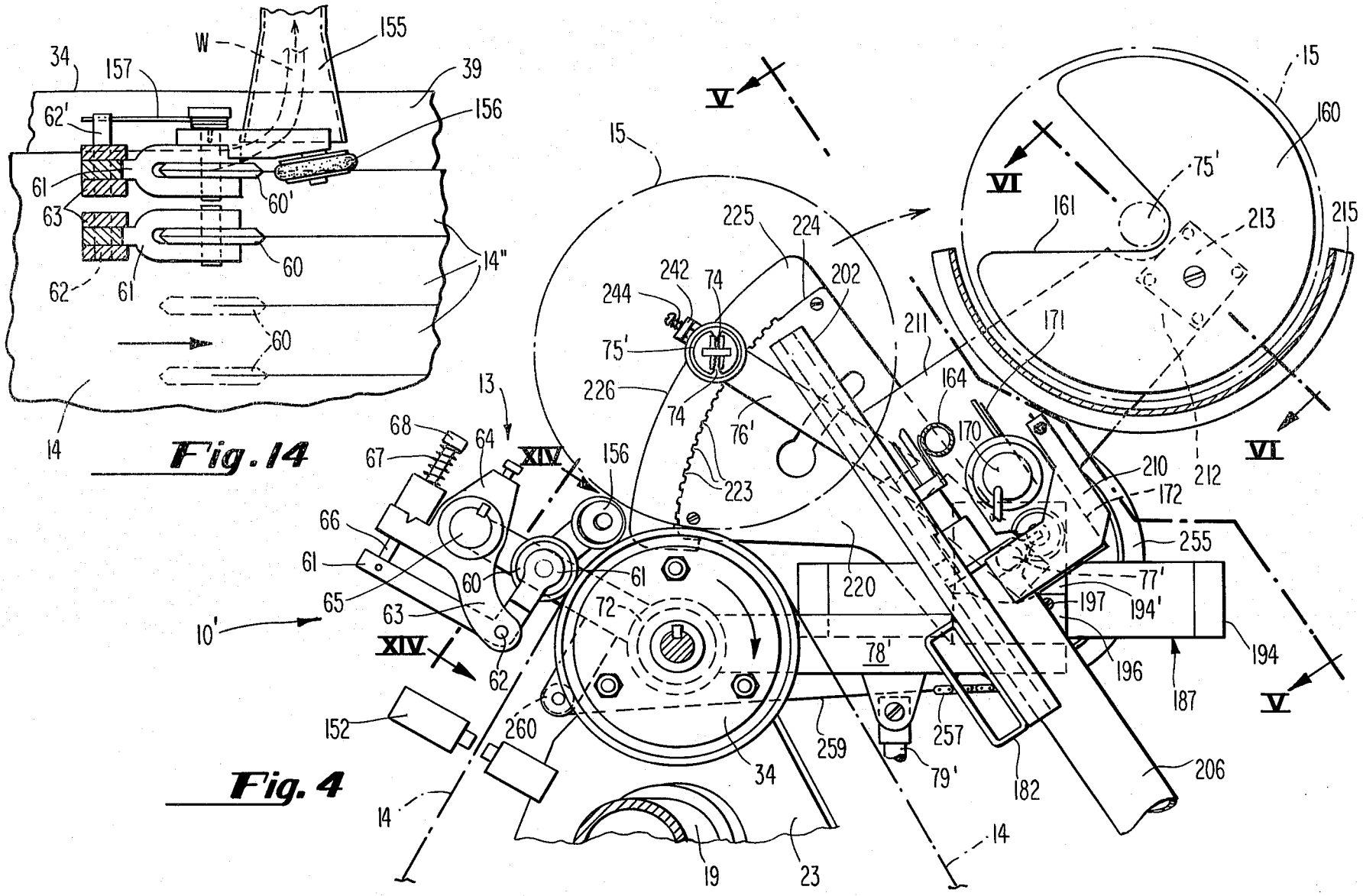
FIG. 4 is an enlarged, fragmentary view in transverse section indicated by the arrows IV—IV of FIG. 2, but showing a modification of the fabric cutting machine of this invention, the same including a novel automatic doffing mechanism.
FIG. 14 is an enlarged, fragmentary view in section indicated by the arrows XIV—XIV of FIG. 4, showing means for trimming and removing the advancing edge portion of the fabric tube.
Figure 5:
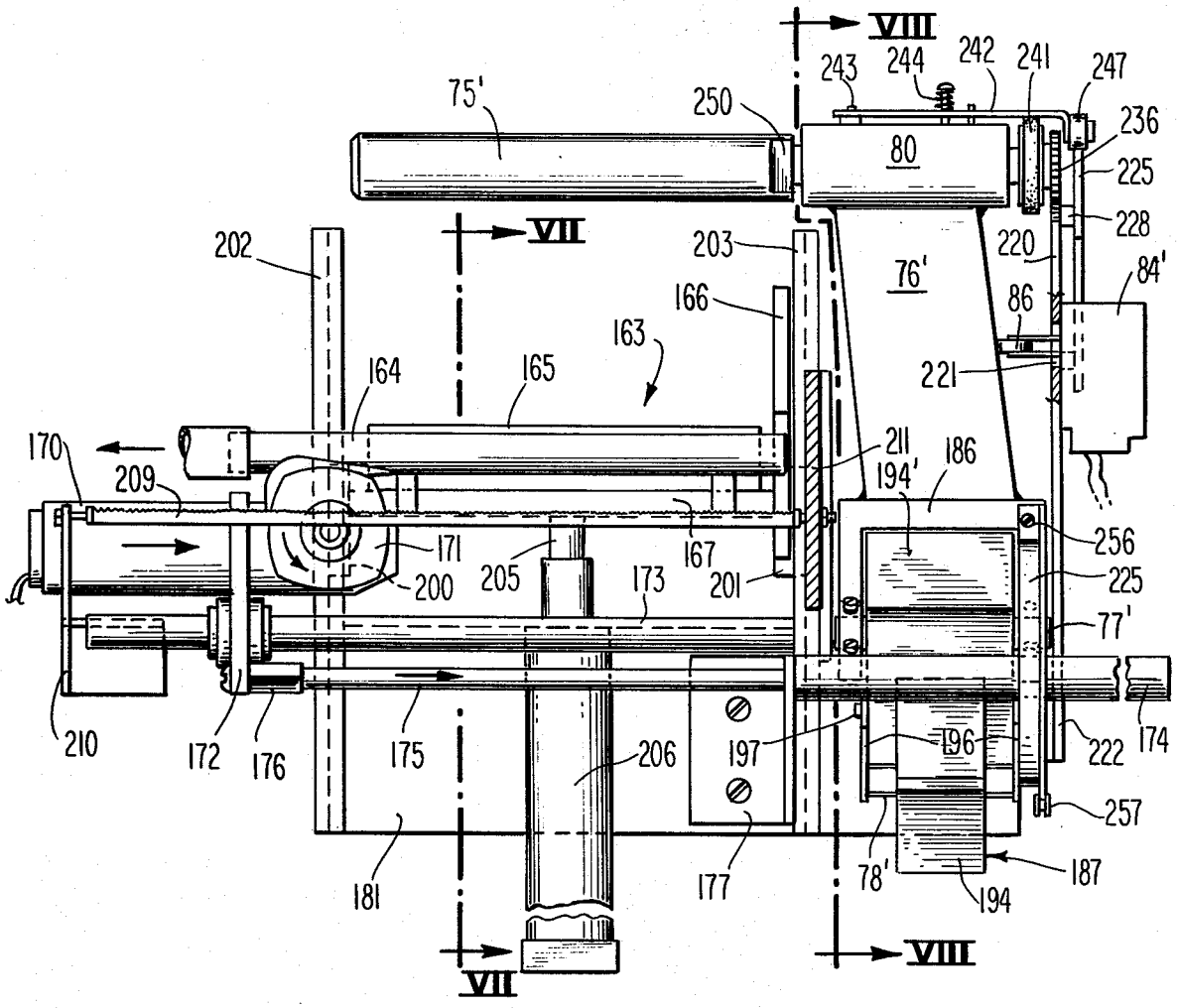
FIG. 5 is a fragmentary view in section indicated by the arrows V—V of FIG. 4.
Figure 8:
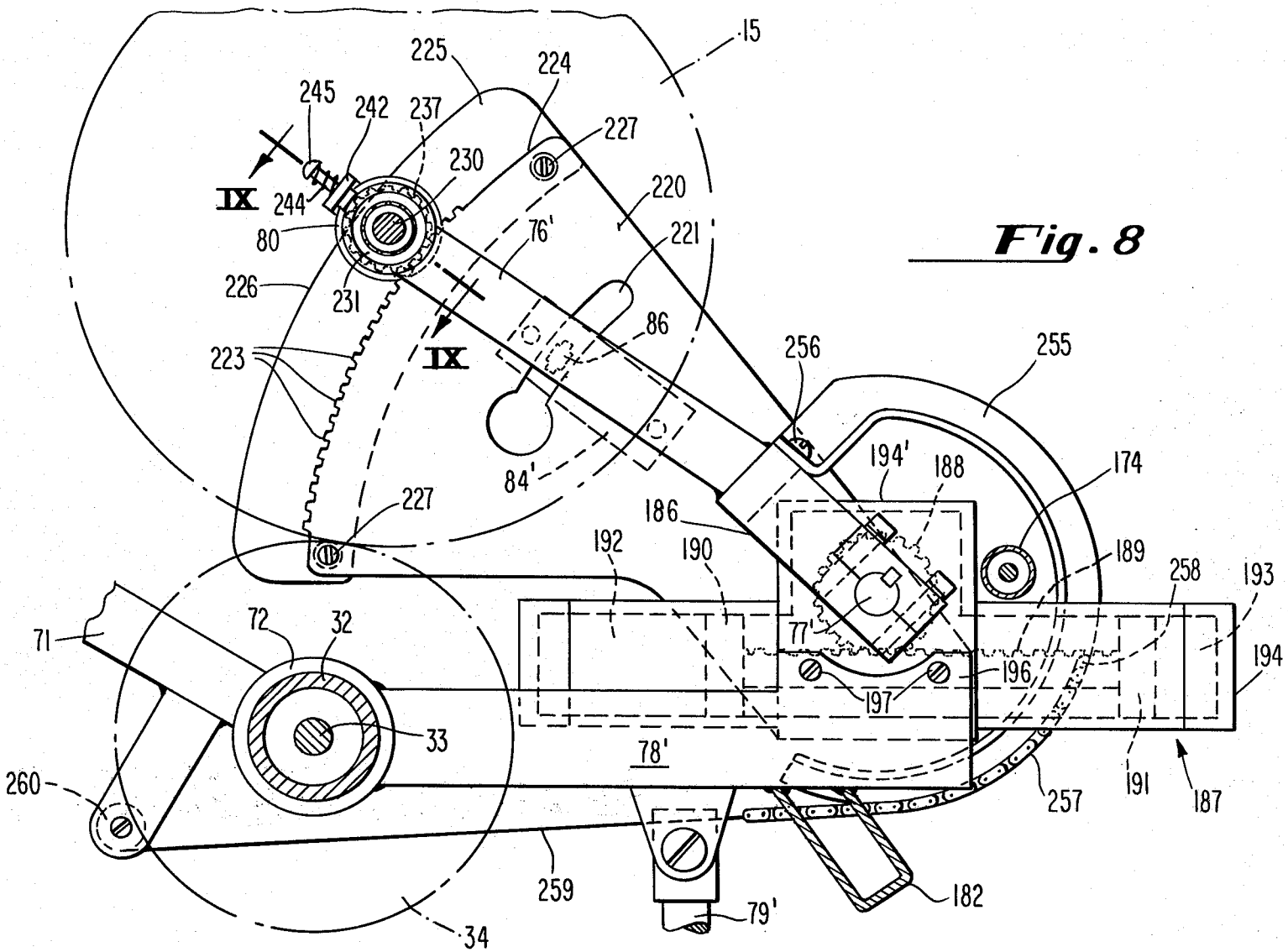
FIG. 8 is an enlarged, fragmentary view in section indicated by the arrows VIII—VIII of FIG. 5.

The structure and details of the automatic doffing mechanism for the machine 10' of this invention are illustrated in FIGS. 4 to 12 inclusive. FIG. 4 shows the cutting and rolling section 13 of the machine 10', including the rotatable cylinder 34, plural cutters 60, rotatable friction wheel 156, rotatable mandrel 75' with its diametrically spaced, elongated re-threading slots 74, swingable mandrel arm 76', stud shaft 77' and ejector pad 160 with its notch 161. Mandrel 75' extends axially from, and is supported rotatably by, the distal end 80 of the swingable arm 76' (FIG. 5). The proximal end of arm 76' terminates in a clevis 186 keyed to stud shaft 77' (FIGS. 5, 8).

Stud shaft 77' is actuated by a double acting rotary device or actuator 187 of conventional design, which includes a pinion 188 (FIG. 8) affixed, by any suitable means, to shaft 77' intermediate its outer ends. The pinion 188 meshes with a reciprocal rack 189, having pistons 190, 191 affixed to its opposite ends. The pistons 190, 191 are mounted slidably within the axially spaced cylinders 192, 193, respectively. The rotary actuator 187 is provided with a casing 194 for its internal elements comprising pinion 188, rack 189, pistons 190, 191 and cylinders 192, 193. The spaced sides of the intermediate widened portion 194' of the casing 194 are provided with suitable apertures (not shown) to permit emergence of the opposite ends of the stud shaft 77' from the casing. As will be understood, suitable high pressure fluid may be introduced into the cylinders 192, 193, to cause the pistons 190, 191 to reciprocate the rack 189 forward or reverse, thereby causing the arm 76 to swing in either a clockwise or counterclockwise direction about the center of stud shaft 77'. In the absence of high pressure fluid in the cylinders, arm 76 is freely swingable about the center of shaft 77', within the angular limits permitted by the periphery of cylinder 34 and the notch of ejector pad 160 (FIG. 4).

The ensemble comprising swingable arm 76', shaft 77' and rotary device 187 is supported by a pair of brackets 78', 79'. Bracket 78' is affixed to the collar 72 (FIGS. 3, 8) and extends outwardly therefrom, having the rotary device 187 affixed in its distal end. The upper portion of bracket 78' has a longitudinally extending, channel-like section or configuration, adapted to receive snugly the center portion 194' of the casing 194 of the rotary device 187. The distal end of the bracket 78' is provided with a pair of transversely spaced members 196, through which bolts 197 engage threadingly with the casing center portion 194'. Depending bracket 79' extends downwardly and has its lower end (not shown) secured to a suitable location of the frame of the machine 10'.

Figure 6:
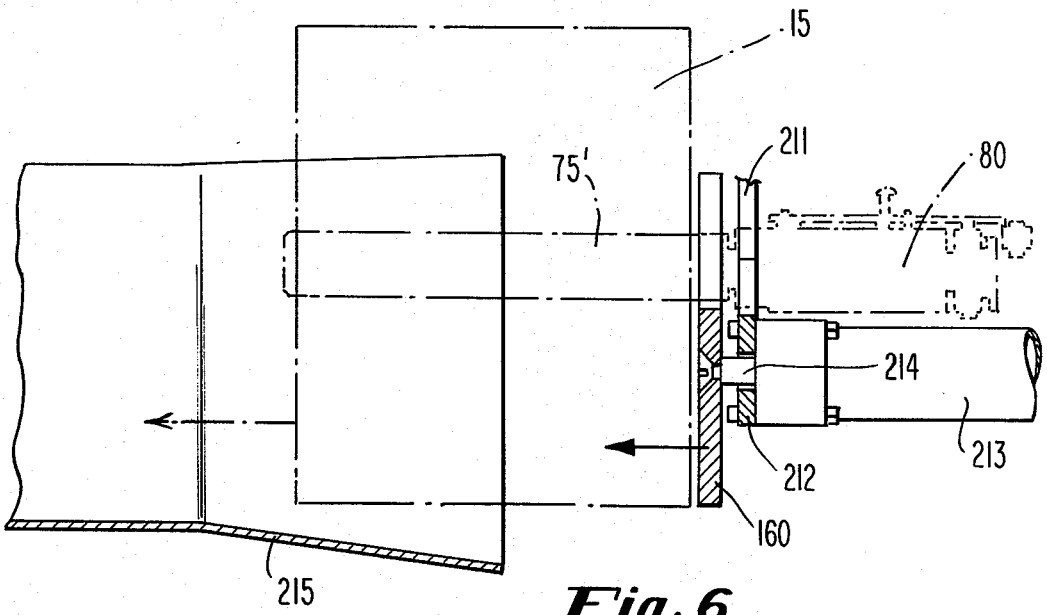
FIG. 6 is a fragmentary view in section indicated by the arrows VI—VI of FIG. 4, illustrating the doffing of rolls of cut fabric from the rotatable mandrel of the modified machine.

FIGS. 5–7 show in detail the automatic fabric severing, removal and re-threading components of the doffing mechanism of the machine 10'. There is depicted in FIG. 5 microswitch 84' provided with a retractable actuator 86, stuffer assembly 163 mounting suction tube 164 and stuffer blade 165, and rotary shear 170 having rotatable cutting blade 171. The suction tube 164 and stuffer blade 165 are affixed to an elongated support yoke 167 by suitable means, such as threaded bolts. The yoke 167 is provided, at its opposite ends, with tongue-like slides or guides 200, 201 which engage respectively, slidably within the grooves of a pair of horizontally spaced elongated tracks 202, 203 of generally U-shaped sectional configuration. The elongated upper end 166 of the stuffer assembly 163 is either affixed to, or formed integrally with, the slide 201. The support yoke 167 is affixed to the outer end of a piston rod 205 of a three position penumatic cylinder 206. The stuffer assembly 163 is advanced and retracted as previously explained, with the guides 200, 201 sliding in the grooves of the tracks 202, 203, by the programmer-controlled cylinder 206.

The motor driven rotary shear 170 is supported by a bracket 172 mounted slidably on elongated guide rod 173. Slidable bracket 172 is advanced and retracted axially along guide rod 173 by a pneumatic cylinder 174 provided with a piston rod 175, the outermost end 176 of which is secured by any suitable means to bracket 172. Cylinder 174 is supported in fixed position by a right-angled bracket 177 suitably secured to the support frame for the doffing mechanism. By means of the arrangement shown, the programmer-controlled cylinder 174 is operative to advance the rotary shear 170 transversely of the unwound fabric strips 14" to sever them (FIG. 13*c*), and to retract the shear following fabric severing.

FIG. 7 is a view similar to FIG. 13*c*, showing in detail the construction and mounting of the various parts of the stuffer assembly 163 and its associated components. In FIG. 7, the plural fabric rolls 15 are in doffing position, with their trailing, unwound strips of fabric 14" extending to the tubular fabric 14 on cylinder 34. The suction tube 164 is in engagement with the fabric strips 14". Suction tube 164 is provided with a plurality of axially spaced suction holes 168 which are operative to retain the loose ends of the fabric strips 14" extending from the cylinder 34 following cutting of those strips by the retractable rotary shear 170. The slidable bracket 172 for the rotary shear 170 is provided with a split bushing 178 slidably engageable with the guide rod 173. The guide rod 173 is supported by an elongated rail 179 having an axially extending, transversely protruding tongue 180 fixedly engaged within a complemental, axially extending groove formed in the rod. Rail 179, in turn, is supported by the distal end of a right-angled bracket 181, which also supports the pneumatic cylinder 206. The bracket 181 is affixed to an elongated hollow support 182 which, in turn, is affixed to and sustained by bracket 78'.

As shown in FIG. 7, support yoke guide 201 is provided with an upstanding finger 183 disposed generally parallel to, and spaced from the elongated upper end 166 of that guide. The separation between finger 183 and the elongated extension 166 provides a slot 184. If desired, to assist in maintaining the several fabric strips 14" stable and taut during cutting by the rotary shear 170, an elongated, transversely extending friction element 209, supported by spaced brackets 210, 211 (FIG. 5), may be provided. The upper edge of friction element 209 may be serrated. Bracket 211 is elongated, and supports at its distal end 212 a pneumatic cylinder 213 (FIGS. 4, 6).

FIG. 6 illustrates the removal of the plural rolls 15 of cut fabric from the rotatable mandrel 75', and their discharge into an elongated storage tray or cradle 215 of generally arcuate section. The ejector pad 160 is affixed to the outer end of piston rod 214 of the cylinder 213. The cylinder 213 is controlled by the programmer (not shown) previously referred to. It is operative, after severing of the fabric strips 14' by the rotary shear 170 (FIG. 13*c*), to advance the ejector pad 160 to remove the fabric rolls 15 from the mandrel 75', following which ejector pad 160 is retracted by the cylinder. A weight-loaded or spring-loaded strap (not shown) may be utilized to maintain the fabric rolls 15 upright in the tray 215, when the ejector pad 160 is retracted.

Figure 11:
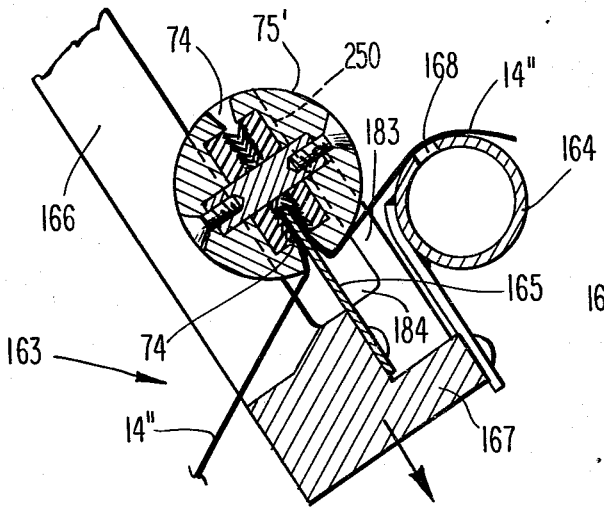
FIG. 11 is an enlarged, fragmentary view in section of the mandrel, indicated generally by the arrows XI—XI of FIG. 9.
Figure 12:
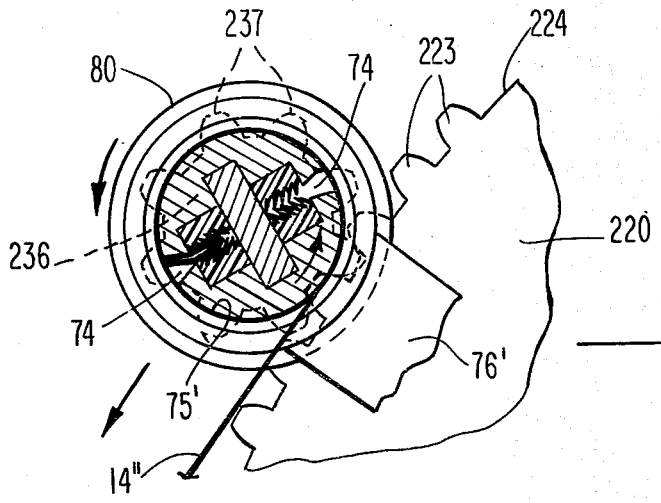
FIG. 12 is an enlarged, fragmentary view in vertical section, showing the empty mandrel of FIG. 9 in the process of returning to fabric wind-up position relative to the modified machine, following doffing.

FIGS. 8–12 illustrate in detail the construction of the rotatable mandrel 75' and its associated mechanisms. FIGS. 8 and 12 are views generally similar to FIG. 13*f*, in that they illustrate the mandrel arm 76' disposed intermediate the ejector pad 160 and the rotatable cylinder 34. At such location, the mandrel 75' has been "threaded" with the cut ends of the fabric strips 14", and is being caused to rotate about its axis by the plate 220 to wrap the ends of the fabric strips 14" about its periphery.

Plate 220 is of generally angular or segmental configuration, and is affixed at its reduced inner end 222 (FIG. 5) to mandrel support bracket 78'. The distal end of plate 220 is of generally arcuate configuration (FIG. 8). The lower portion of its outer end is provided with a plurality of raised teeth 223 disposed in the form of a curved rack, and the upper portion 224 is formed as a smooth curved edge. Plate 220 is provided with an arcuate slot 221, through which extends the retractable actuator 86 of the microswitch 84'. Affixed to the distal or outer end of plate 220, and spaced therefrom, is an arcuate cam plate 225, the outer cam edge 226 of which is of smooth arcuate configuration. Cam plate 225 is affixed to segmental plate 220 by spaced bolts 227. Plates 220 and 225 are maintained in spaced relation to each other by means of tubular spacers 228 (FIG. 5) through which pass the bolts 227.

Figure 9:
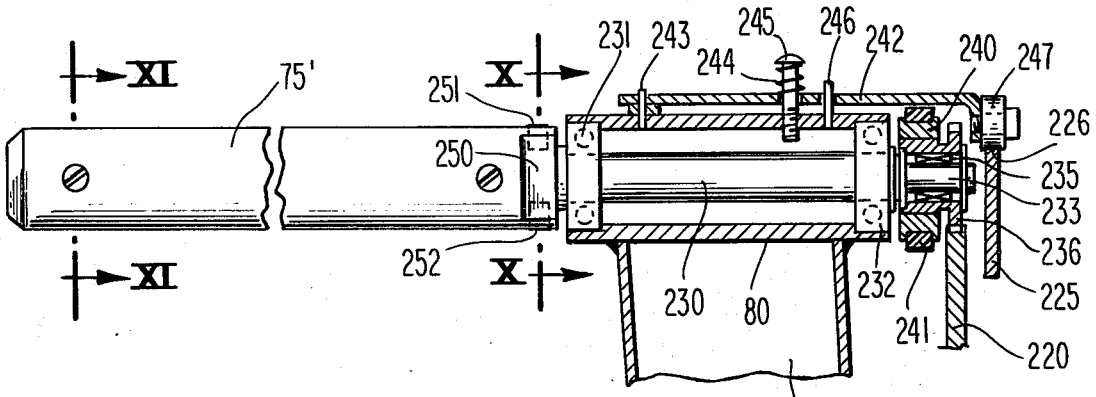
FIG. 9 is a fragmentary view, partly in section, indicated by the arrows IX—IX of FIG. 8, showing the rotatable mandrel on which cut strips of fabric are wound into rolls, together with the mandrel support and rotating mechanism.

Referring now to FIG. 9, it will be observed that mandrel 75' is provided with a reduced shaft portion 230 supported rotatably by spaced roller bearings 231, 232 mounted internally of the tubular distal end 80 of the mandrel arm 76'. The mandrel shaft 230 extends completely through the hollow end 80 of arm 76', and terminates in a second reduced shaft portion 233, extending outwardly of support end 80. Mounted on shaft portion 233 is a one-way roller clutch 235 which, in turn, supports a rotatable toothed sprocket wheel 236. The circle of teeth 237 of sprocket wheel 236 mesh with the teeth 223 of plate 220 (FIGS. 8, 12).

Sprocket wheel 236 is provided with a recessed hub 240 which mounts an annular brake band 241 composed of any suitable friction brake material. Brake 241 is adapted to be engaged by a retractable, spring-loaded brake arm 242 mounted pivotally, by any suitable means 243, on the periphery of the tubular element 80. Brake arm 242 is spring-biased in the direction of the brake band 241 by a coil spring 244 disposed about the shaft of a threaded element or bolt 245. A guide pin 246 mounted in tubular member 80 extends through a suitable aperture in the brake arm 242, and aids in maintaining the brake arm in proper alignment with the brake band 241. A roller 247 is mounted rotatably at the distal end of the brake arm 242, and is adapted to engage the arcuate cam edge 226 of the cam plate 225. Engagement of brake arm roller 247 with the cam 226 raises the brake arm, against the force of the spring 244, to separate the brake arm from the annular brake band 241. When roller 247 is disengaged from the cam edge 226, spring 244 causes brake arm 242 to advance into frictional contact with the brake 241, to apply a mild braking effect on the rotatable mandrel assembly.

As the mandrel arm 76' is swung outwardly by the rotary device 187, in the direction of the ejector pad 160 (FIG. 13*b*), the trailing cut fabric strips 14" cause the several rolls 15 of fabric to unwind slightly. The one-way roller clutch 235 affixed to the mandrel 75' permits free rotation of the mandrel for this purpose, notwithstanding the engagement of the sprocket wheel teeth 237 with the teeth 223 of plate 220. During the initial period of retraction of the mandrel 75', loaded with the fabric rolls 15, from the cylinder 34, brake arm roller 247 is engaged with the cam 226, thereby separating the brake arm 242 from the annular brake 241. After the mandrel 75' has retracted beyond the arcuate end of cam plate 225, roller 247 is disengaged from the cam, whereupon spring 244 biases the brake arm 242 into contact with the friction brake 241. The braking effect exerted by the spring-biased arm 242 on the brake 241 prevents the fabric rolls 15 from unwinding excessively as the mandrel advances into, and comes to rest within, notch 161 of ejector pad 160 (FIG. 13*c*). After the rolls 15 have been removed from the mandrel 75', and the mandrel commences its return to the cylinder 34 (FIG. 13*d*), roller 247 re-engages cam 226, to retract the brake arm 242 from the brake 241. Roller 247 re-engages can 226 at the location of the smooth curved edge 224 on plate 220 adjacent teeth 223. Since the teeth 237 of the sprocket wheel 236 are not yet in engagement with the teeth 223 of plate 220, the separation of the brake arm 242 from brake 241 renders mandrel 75' freely rotatable.

The end of mandrel 75', adjacent its reduced shaft 230, is provided with a flattened portion 250, the spaced flat surfaces of which are parallel. End portion 250 is of a thickness approximating the width of the slot 184 in the stuffer assembly 163, whereby the flattened end 250 is engageable snugly within the slot 184 (FIG. 11). The end portion 250 of mandrel 75' may be provided with diametrically spaced high friction inserts 251, 252 snugly retained within recesses formed in the mandrel.

As illustrated in FIGS. 11 and 12, the diametrically opposed, axially extending, fabric threading slots 74 may be provided with friction material of any suitable type, to aid in retaining securely the cut ends of the fabric strips 14" inserted into the slots by the stuffer blade 165. To facilitate the stuffing or "threading" of the cut fabric strips 14" into the slots 74, the outer faces of the stuffer blade 164 may be provided with a relatively smooth or slick surface.

Figure 10:
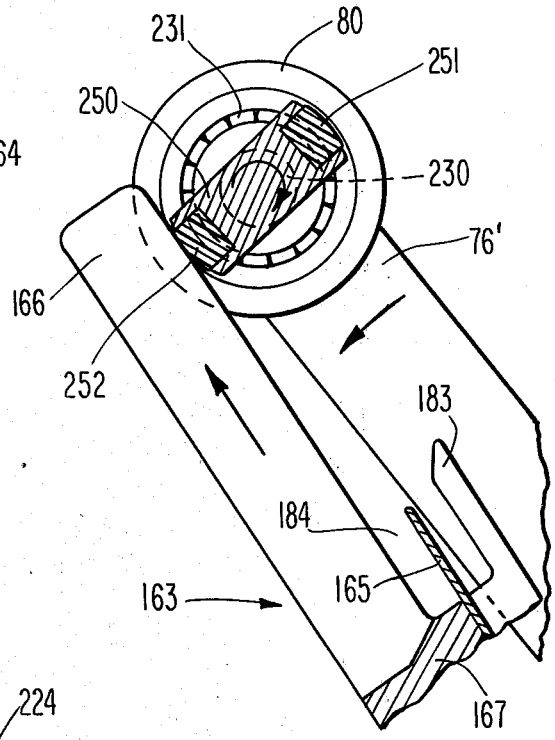
FIG. 10 is an enlarged, fragmentary view in section of the mandrel, indicated generally by the arrows X—X of FIG. 9.

FIG. 10 is a view generally similar to FIG. 13*d*, in that it illustrates the stuffer assembly 163 advanced upwardly to its second position, with the empty mandrel 75' in contact with the elongated upper end 166. The latter is disposed so as to be contacted by the flattened portion 250 of the mandrel, as the mandrel begins its return to the cylinder 34. As its location illustrated in FIGS. 10 and 13*d*, the mandrel 75' is freely rotatable, since brake arm roller 247 has disengaged the brake arm from brake 241, and the sprocket wheel teeth 237 have not yet engaged the arcuate rack 223. After the flattened end 250 of mandrel 75' has contacted the upper end 166, the stuffer assembly 163 rises for the second time. As the stuffer assembly 163 again moves up, the frictional contact between its upper end 166 and the flattened end 250 of mandrel 75' causes the mandrel to be rotationally oriented, so that its elongated threading slots 74 are disposed in co-planar relation to the stuffer blade 165, and its flattened end 250 is aligned axially with slot 184. The high friction character of the inserts 251, 252 in the flattened end 250 assist in the rotational orientation of the mandrel 75'.

FIG. 11 is a view generally similar to FIG. 13*e*, in that it illustrates the stuffer assembly 163 in its most upward location, with the stuffer blade 165 in the process of "threading" the cut ends of the fabric strips 14" into one of the slots 74 of the mandrel. In FIG. 11, the flattened end 250 of the mandrel 75' is shown as being disposed snugly within the slot 184, between elongated end 166 and finger 183 of the stuffer assembly 163. The engagement of the flattened mandrel end 250 snugly within the slot 184 remains the mandrel secure while the stuffer blade 165 folds and forces the cut ends of fabric 14" into the lower mandrel slot 74. Thus, the elongated upper end 166 of the stuffer assembly 163 functions as a mandrel stop-positioner to arrest temporarily the advance of the mandrel during its return to the cylinder 34, and to orient it for alignment of its slots 74 with the stuffer blade 165.

Upon the withdrawal of the stuffer assembly 163 (FIG. 13*f*), the mandrel 75' advances by gravity to the cylinder 34. As the sprocket wheel teeth 237 engage the teeth of the arcuate rack 223, rotational motion is imparted by the sprocket wheel 236 via the one-way roller clutch 235 to shaft 230, whereby mandrel 75' is caused to rotate to wrap the cut ends of the fabric strips 14" around its surface (FIG. 12).

Preferably, the tension on the cut strips of fabric 14" should remain substantially constant during their formation into rolls 15 on mandrel 75'. To minimize the variable tensioning effect of the weight of mandrel 75' on the cut fabric, a spring-biased counterbalancing means may be employed (FIG. 8). Such means includes ring 255 affixed by bolt 256 to clevis 186 at the proximal end of mandrel arm 76'. A chain 257 has one end pivoted at 258 to ring 255, and has its other end fastened to the outer end of a clock-like spring 259, the opposite end of which is formed into a rotatable spring helix 260. By reason of such counterbalancing means, the variable effect of the weight of mandrel 75' and its associated parts may be controlled, to minimize tension variations on the fabric strips 14" and uniformize the firmness of the fabric rolls 15.

To secure optimum results, the tubular fabric 14 should remain untwisted during its passage from the fabric supply 11 to the spreader 112. This is achieved by providing the tubular fabric 14 in a plurality of stacked, untensioned folds 14' in the tray 89 (FIG. 1), and by correlating the speed of rotation of tray 89 with the rotational speed imparted by the advancing fabric tube to the freely rotatable spreader 112.

In practice, it is preferred that a 1:1 speed ratio be maintained between the rotating fabric tray 89 and rotating fabric spreader 112. As explained in U.S. Pat. application Ser. No. 644,569 aforesaid, this may be accomplished manually by the proper longitudinal setting of the tray 89, relative to the remainder of the machine 10, by handle 109 (FIG. 1). However, in the modified, more fully automated machine 10' of FIG. 4 et seq., the rotational speeds of the fabric tray 89 and the fabric spreader 112 may be continuously monitored, and adjusted automatically as required, to maintain the 1:1 ratio. Any suitable, well known electronic rotational sequencing or sensing mechanism (not shown) may be employed for this purpose. In such arrangement, the rotating spreader 112 is the master element and the rotating tray 89 is the slave required to rotate at a 1:1 ratio with the spreader. The electronic sequencing or sensing mechanism utilized in such arrangement continuously monitors the speed of rotation of the fabric tray 89, and is operative to adjust its variable speed drive automatically to maintain the desired 1:1 speed ratio.

If desired, suitable electronic control means (not shown) may be provided for motor 44 (FIG. 1) to permit a preselected slow acceleration during machine start-up and a pre-selected slow deceleration when operation of the machine is to be halted. By such arrangement, excessive stretching of the tubular material 14 due to the inertia of the machinery, at the beginning and the end of a machine cycle, is avoided.

Thus, the machine 10' illustrated in FIGS. 4–16 is provided with automated means for maintaining the tubular fabric 14 in substantially untwisted and wrinkle-free condition as it is advanced continuously at a selected, uniform rate of feed to the multiple cutters 60. When the cut rolls 15 of the fabric have reached a predetermined size, the machine is stopped automatically. The mandrel 75' supporting the several cut rolls of fabric is retracted, the fabric rolls doffed, and the empty mandrel then returned prepared for resumption of machine operation. The automated controls and mechanisms of the machine 10' permit the machine to operate unattended for long periods of time, during which the tubular fabric 14 is advanced, cut and rolled into a plurality of successive batches of rolls of cut fabric 15, each of which is deposited automatically in the receiving tray 215. The machine will continue to operate automatically, until the supply of tubular fabric in the rotatable supply tray 89 is exhausted.

In the claims which follow, the expression "skew angle of the cylinders" shall indicate the oblique angle formed by the axis or center line of any one of the three shafts of the cylinders 26, 29, 34 with respect to the axis or center line of the main support tube 19, when the cylinders are disposed in skewed relationship to each other.

Although preferred embodiments of this invention have been shown and described for the purpose of illustration, as required by Title 35 U.S.C. §112, it is to be understood that various changes and modifications may be made thereto without departing from the spirit and utility of the invention or the scope thereof, as set forth in the appended claims.

We claim:

1. A machine for continuously cutting plural bias strips from an advancing tube of material, including:

(a) a supply of tubular material, (b) a plurality of cutters for cutting the tubular material into a plurality of individual strips, (c) a rotatable mandrel for winding the cut strips of material into plural rolls, (d) at least two skewable, transversely spaced, rotatable cylinders for supporting the tubular material internally and advancing the tubular material axially from the supply to the cutters, (e) adjustment means for skewing the cylinders selectively relative to each other, to cause the tube of material to advance to the cutters at a selected rate of speed, (f) material tensioning means interposed between the supply of material and the skewable cylinders, said tension means being disposed internally of the advancing tube of material, (g) adjustment means associated with the tension means for imposing a selected tension on the advancing tube of material, (h) sensing means for monitoring the rate of advance of the tubular material to the cutters, (i) first control means responsive to the sensing means and automatically operative to adjust the skew angles of the cylinders, as required during machine operation, to maintain the rate of advance of the tubular material at the selected rate of speed, and (j) second control means responsive to the sensing means and automatically operative to adjust the tension means, as required during machine operation, to maintain the tube of material substantially wrinkle-free as it advances at the selected rate of speed.

2. The machine of claim 1, further including doffing means automatically operative to remove the plural rolls of material from the mandrel, after the rolls have reached a predetermined size.

3. A machine for continuously cutting bias strips from tubes of material, including:

(a) a supply of tubular material, (b) cutting means for cutting the tubular material into at least one helically cut strip, (c) a rotatable mandrel for winding cut strips of material into rolls, (d) at least two skewable, transversely spaced, rotatable cylinders for supporting to tubular material internally and advancing the tubular material axially from the supply to the cutting means, (e) means for skewing the cylinders selectively relative to each other, to cause the tube of material to advance to the cutting means at a selected rate of speed, (f) material tensioning means interposed between the supply of material and the skewable cylinders, said tension means being disposed internally of the advancing tube of material, (g) means associated with the tension means for imposing a selected tension on the advancing tube of material and (h) adjustment means automatically operative during machine operation to monitor the advance of the tube of material and to adjust the skew of the cylinders and the tension imposed on the material, whereby the tube of material is advanced continuously in a substantially wrinkle-free condition at a uniform rate of feed.

4. A machine for continuously cutting bias strips from tubes of material, including:

(a) a supply of tubular material, (b) cutting means for cutting the tubular material into at least one helically cut strip, (c) a rotatable mandrel for winding cut strips of material into rolls, (d) at least two skewable, transversely spaced, rotatable cylinders for supporting the tubular material internally and advancing the tubular material axially from the supply to the cutting means, (e) adjustment means for skewing the cylinders selectively relative to each other, to cause the tube of material to advance to the cutting means at a selected rate of speed, (f) sensing means for monitoring the rate of advance of the tubular material to the cutting means and (g) control means responsive to the sensing means and associated with the adjustment means, said control means being automatically operative to adjust the skew angles of the cylinders, as required during machine operation, to maintain the rate of advance of the tubular material at the selected rate of speed.

5. The machine of claim 4, further including means for maintaining the tube of material under selected tension as it advances to the cutting means, said tensioning means comprising:

(a) a freely rotatable spreader interposed between the supply of material and the skewable cylinders, said spreader being disposed internally of the advancing tube of material, (b) a plurality of annularly spaced, articulated tension ribs mounted on the spreader for imposing a frictional drag on the advancing tube of material, (c) adjustment means associated with the ribs for varying selectively the frictional drag imposed on the material and (d) control means responsive to the sensing means and associated with the adjustment means, said control means being automatically operative to adjust the frictional drag imposed by the ribs, as required during machine operation, to maintain the advancing tube of material substantially wrinkle-free as it advances at the selected rate of speed.

6. The machine of claim 5, further including doffing means automatically operative to remove the rolls of material from the mandrel, after the rolls have reached a predetermined size.

7. A machine for continuously cutting bias strips from tubes of material, including:

(a) a supply of tubular material, (b) cutting means for cutting the tubular material into at least one helically cut strip, (c) a rotatable mandrel for winding cut strips of material into rolls, (d) positive feeding means for advancing the tubular material from the supply to the cutting means, (e) material tensioning means interposed between the supply of material and the positive feeding means, said tension means being disposed internally of the advancing tube of material, and including means for imposing a frictional drag on the advancing tube of material, (f) adjustment means associated with the material tension means for varying selectively the frictional drag imposed on the material, (g) sensing means for monitoring the advance of the tubular material to the cutting means and (h) control means responsive to the sensing means and associated with the adjustment means, said control means being automatically operative to adjust the frictional drag imposed by the tension means on the material, as required during machine operation, to maintain the tube of material substantially wrinkle-free as it advances to the cutting means.

8. A machine for continuously cutting plural bias strips from an advancing tube of material, including:

(a) a supply of tubular material, (b) a plurality of cutters for cutting the tubular material into a plurality of individual strips, (c) a plurality of skewable, transversely spaced, rotatable cylinders for supporting the tubular material internally and advancing the tubular material axially from the supply to the cutters, (d) a rotatable mandrel for winding the cut strips of material into plural rolls, (e) said mandrel being surface driven from one of the cylinders, whereby the cut strips are wound into rolls on the periphery of said cylinder, and (f) doffing means automatically operative to remove the plural rolls of material from the mandrel, after the rolls have reached a predetermined size.

9. The machine of claim 8, wherein the rotatable mandrel is pivotal for angular movement between a material winding position proximate the cylinders and a material removal position remote from the cylinders, said doffing means including:

(a) means automatically operative for retracting the mandrel from the material winding position to the material removal position, after the rolls have reached a predetermined size, and for returning the empty mandrel to the material winding position following removal of the rolls, and (b) means automatically operative to discharge the rolls from the mandrel while the mandrel is in the material removal position.

10. A machine for continuously cutting bias strips from tubes of material, including:

(a) a supply of tubular material, (b) cutting means for cutting the tubular material into at least one helically cut strip, (c) positive feeding means for advancing the tubular material from the supply to the cutting means, (d) a rotatable mandrel for winding cut strips of material into rolls, (e) said mandrel being movable between a first position proximate the machine for winding cut strips of material into rolls on the mandrel and a second position remote from the machine where the rolls are removed from the mandrel, (f) means automatically operative for moving the mandrel from the first position to the second position, after the rolls have reached a predetermined size, and for returning the mandrel to the first position following removal of the rolls from the mandrel, and (g) means automatically operative to remove the rolls from the mandrel while the mandrel is in the second position

11. The machine of claim 10, further including cutting means automatically operative to sever the cut strips forming the rolls from the tubular material, after the mandrel has been moved to the second position.

12. The machine of claim 11, further including suction means for retaining severed strips of material extending from the tubular material following severing of the rolls from the tubular material.

13. The machine of claim 12, further including means automatically operative to re-thread the empty mandrel with severed strips of material, during return of the mandrel to the first position.

14. The machine of claim 13, further including means for rotating the mandrel, following re-threading, as the mandrel returns to the first position, to wrap the severed strips of material around the mandrel.

15. The machine of claim 14, wherein the mandrel is provided with at least one re-threading slot for reception of cut strips of material, further including:

(a) a stuffer blade for inserting cut strips of material into a mandrel slot,
(b) means for rotationally orienting the rotatable mandrel to align a slot with the stuffer blade and
(c) means for advancing the stuffer blade relative to the aligned slot to insert cut strips of material into the slot.

16. The machine of claim 10, further including:
(a) cutting means automatically operative to sever the cut strips forming the rolls from the tubular material, after the mandrel has been moved to the second position and
(b) a stuffer assembly disposed intermediate the first and second mandrel positions and incorporating
(i) suction means for retaining taut severed strips of material extending from the tubular material following separation of the rolls from the tubular material and
(ii) re-threading means for re-threading the empty mandrel with cut strips of material, during return of the mandrel to the first position.

17. A method for the continuous bias cutting of an elongated tube of material into a plurality of helically cut strips, and winding the cut strips into a plurality of separate rolls, comprising the steps:
(a) providing a supply of material,
(b) advancing the tubular material by positive feeding means from the supply to a plurality of individual cutting means at a uniform rate of feed,
(c) opening the tubular material and applying a selected tension thereto as it advances from the supply, to maintain the advancing tube substantially wrinkle-free as it advances to the cutting means,
(d) cutting the advancing tube of material into a plurality of strips, and forming the cut strips into a batch of separate rolls of material, and
(e) continuously monitoring the advancing tube of material, and adjusting automatically its rate of advance and the tension applied thereto, as required during cutting of the material, whereby to advance continuously the tube of material to the cutting means in a substantially wrinkle-free condition at the uniform rate of feed.

18. The method of claim 17, utilizing a machine wherein the positive feeding means comprises a plurality of skewable rotatable cylinders, and wherein a rotatable spreader disposed internally of the tubular material opens and tensions the material, said spreader having a plurality of friction elements for imposing a selected frictional drag on the advancing tube of material, further including the steps:
(a) setting the cylinders at selected skew angles relative to each other to advance the tube of material at a selected rate of feed,
(b) selectively setting the frictional drag imposed by the friction elements on the material, whereby said tube is advanced in substantially wrinkle-free condition,
(c) continuously monitoring the advancing tube of material by photoelectric sensing means and
(d) adjusting automatically the skew angles of the cylinders and the frictional drag imposed by the friction elements, in response to signals generated by the photoelectric sensing means, to maintain the advancing tube of material in a substantially wrinkle-free conidition and at the uniform rate of feed.

19. The method of claim 18, further including the step of doffing automatically the batch of rolls of cut material after the rolls have reached a predetermined size.

20. The method of claim 19, further including alternately repeating the following:
(a) cutting of the material into strips and forming the strips into a batch of rolls and
(b) doffing each batch of rolls after they have reached the predetermined size.

21. The method of claim 17, utilizing a machine wherein the plural strips of cut material are formed into rolls on a retractable mandrel, further including the steps:
(a) retracting the mandrel from the machine, with a batch of rolls of cut material disposed thereon, after the rolls have reached a predetermined size,
(b) removing the rolls from the mandrel,
(c) re-threading the empty mandrel with strips of cut fabric and
(d) advancing the re-threaded mandrel to the machine, preparatory to forming a new batch of rolls of material on the mandrel.

22. The method of claim 17, further including the steps:
(a) carrying out a machine cycle of material feeding, cutting and rolling into separate rolls of cut material of predetermined size,
(b) then carrying out a doffing cycle of retracting the rolls of cut material to a discharge position and discharging the rolls and
(c) alternately repeating said machine and doffing cycles.

23. The method of claim 22, further including the step of separating the rolls of cut material from the tubular material during each doffing cycle.

24. A method for the continuous bias cutting of an elongated tube of material into at least one helically cut strip, comprising the steps:
(a) providing a supply of material,
(b) advancing the tubular material by positive feeding means from the supply to a cutting means at a uniform rate of feed,
(c) opening the tubular material and applying a selected frictional drag on the material as it advances from the supply, to maintain the advancing tube substantially wrinkle-free as it advances to the cutting means,
(d) cutting the advancing tube of material into at least one helically cut strip, and forming the cut strips of material into rolls, and
(e) continuously monitoring the advancing tube of material, and adjusting automatically its rate of advance and the frictional drag applied thereto, as required during cutting and rolling of the material, whereby to advance continuously the tube of material to the cutting means in a substantially wrinkle-free condition at the uniform rate of feed.

25. The machine of claim 10, further including counterbalancing means connected to the mandrel for minimizing tension variations on the cut strips of material due to the mandrel, as the cut strips are wound into rolls.

26. The machine of claim 25, wherein the counterbalancing means includes spring means connected to the mandrel and automatically operative to uniformize the effect of the weight of the mandrel on the cut strips, as the strips are formed into rolls of progressively increasing size.

27. The machine of claim 10, further including brake means connected to the mandrel and automatically operative to prevent the rolls from unwinding excessively as the mandrel is moved from the first position to the second position.

28. The machine of claim 10, further including material trimming means disposed proximate the cutting means and automatically operative to trim wastage from the advancing tubular material, and to remove the cut wastage from the machine.

* * * * *